US006422922B1

(12) United States Patent
Okamura et al.

(10) Patent No.: US 6,422,922 B1
(45) Date of Patent: Jul. 23, 2002

(54) WORKPIECE HOLDER FOR POLISHING, APPARATUS FOR POLISHING WORKPIECE AND METHOD FOR POLISHING WORKPIECE

(75) Inventors: Kouichi Okamura, Nakakubiki-gun; Fumio Suzuki, Nishishirakawa-gun; Hisashi Masumura, Nishishirakawa-gun; Kouzi Morita, Nishishirakawa-gun; Naotaka Toyama, Gumma-gun, all of (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 09/647,505

(22) PCT Filed: Feb. 4, 2000

(86) PCT No.: PCT/JP00/00618

§ 371 (c)(1),
(2), (4) Date: Sep. 29, 2000

(87) PCT Pub. No.: WO00/47368

PCT Pub. Date: Aug. 17, 2000

(30) Foreign Application Priority Data

Feb. 12, 1999 (JP) ..... 11-33762

(51) Int. Cl.[7] ..... B24B 1/00

(52) U.S. Cl. ..... 451/41; 451/60; 451/287; 451/288; 451/289; 451/388

(58) Field of Search ..... 451/41, 60, 287, 451/288, 289, 388

(56) References Cited

U.S. PATENT DOCUMENTS 4,597,228 A * 7/1986 Koyama et al. ..... 451/388
5,584,746 A * 12/1996 Tanaka et al. ..... 451/41
6,074,287 A * 6/2000 Miyaji et al. ..... 451/287

FOREIGN PATENT DOCUMENTS

JP 62-165849 10/1987
JP 9-123059 5/1997

* cited by examiner

*Primary Examiner*—Joseph J. Hail, III
*Assistant Examiner*—Shantese McDonald
(74) *Attorney, Agent, or Firm*—Oliff & Berridge, PLC

(57) ABSTRACT

A workpiece holder for polishing comprising a workpiece holder body which is provided with multiple perforated holes for holding a workpiece by vacuum suction and a holder back plate which is closely contacted with a back face of the holder body and has grooves for vacuum, wherein the holder back plate is composed of a synthetic resin and has an Asker C hardness of 70 or higher but lower than 98, and an apparatus for polishing a workpiece and a method for polishing a workpiece utilizing it. By improving the material of holder back plate of a workpiece holder for polishing that holds a workpiece by vacuum suction to enhance sealing with the holder body, thereby developing such a holder back plate that should not transfer deformation of the holder body to the workpiece surface, even if polishing agent slurry is introduced and solidified, to provide a workpiece holder for polishing having a workpiece holding surface of high precision, an apparatus for polishing a workpiece and a method for polishing a workpiece.

6 Claims, 2 Drawing Sheets

WORKPIECE HOLDER FOR POLISHING, APPARATUS FOR POLISHING WORKPIECE AND METHOD FOR POLISHING WORKPIECE

TECHNICAL FIELD

The present invention relates to a workpiece holder for polishing which is used for precision polishing of surface of workpiece such as a semiconductor wafer, an apparatus for polishing a workpiece, and a method for polishing a workpiece.

BACKGROUND ART

In the conventional polishing operation for workpieces, a plate composed of a rigid material such as glass, metal and ceramics is used as a workpiece holder, and a workpiece is held by adhering it on the surface of the holder with an adhesive such as wax, or by vacuum suction using a workpiece holder surface composed of a gas-permeable porous material or a workpiece holder surface provided with multiple perforated holes for suction. The workpiece is pressed to a polishing pad adhered to a turn table while a polishing agent is poured onto the polishing pad, and the workpiece and the polishing pad are rotated to perform the polishing. As shown in FIG. 3, for holding a workpiece W on a workpiece holder 1 by vacuum suction, there is provided a structure that a workpiece holder back plate 4 having grooves 5 for vacuum is provided on a back face of a workpiece holder body 2 to attain sealing with the workpiece holder body 2 and to secure a vacuum way, so that each perforated hole 3 for suction should be communicated to the vacuum way 7 via the grooves 5 of the holder back plate 4, and thereby the workpiece W is held on a workpiece holding surface 8 by vacuum suction.

As the material of the holder back plate 4, metal or hard synthetic resin is conventionally used. In addition, to enhance sealing between the back face of workpiece holder body 2 and the holder back plate 4, an O-ring 6 or the like is also used.

However, during the polishing of the workpiece, polishing agent slurry may be sucked through a small gap between the workpiece held by vacuum suction and the workpiece holding surface of the workpiece holder body. The sucked polishing agent slurry is evaporated to dryness in a space between the back face of the holder body and the holder back plate. As a result, the polishing agent solidified in a space between the holder back plate and the back face of the holder body will be pressurized with the holder back plate by pressure generated by the vacuum suction, and slightly deform the holder body, and such deformation will be transferred to the workpiece surface being polished. Thus, the quality of the polished workpiece surface may be adversely affected. In addition, even the shapes of the grooves on the holder back plate may also be transferred to the workpiece being polished via the holder body.

Furthermore, the O-ring, which is used in order to enhance the sealing between the back face of the holder body and the holder back plate, is likely to suffer from unbalanced load. This may cause uneven distribution of stock removal for polishing within the surface, which may adversely affect flatness of the workpiece.

DISCLOSURE OF THE INVENTION

Therefore, the present invention was accomplished in view of the aforementioned problems, and its main object is to improve the material of holder back plate of a workpiece holder for polishing that holds a workpiece by vacuum suction to enhance sealing with the holder body, thereby developing such a holder back plate that should not transfer deformation of the holder body to the workpiece surface, even if polishing agent slurry is introduced and solidified, to provide a workpiece holder for polishing having a workpiece holding surface of high precision, an apparatus for polishing a workpiece and a method for polishing a workpiece utilizing them.

In order to achieve the aforementioned object, the present invention provides a workpiece holder for polishing comprising a workpiece holder body which is provided with multiple perforated holes for holding a workpiece by vacuum suction and a holder back plate which is closely contacted with a back face of the holder body and has grooves for vacuum, wherein the holder back plate is composed of a synthetic resin and has an Asker C hardness of 70 or higher but lower than 98.

During the polishing of a workpiece, polishing agent slurry may be sucked through a small gap between the workpiece held by vacuum suction and the workpiece holding surface of the workpiece holder body. The sucked polishing agent slurry is solidified by evaporation in a space between the back face of the holder body and the holder back plate. As a result, patterns of the solidified polishing agent will be pressurized with the holder back plate by pressure generated by the vacuum suction. However, if a synthetic resin having an Asker C hardness of 70 or higher but lower than 98 is used as the material of the holder back plate as defined above, the holder back plate should be constituted with a soft resin, and therefore the pressure is absorbed by it. Accordingly, the holder body is no longer deformed, and thus deformation is no longer transferred to the workpiece surface during polishing. Furthermore, the shapes of the grooves themselves for vacuum on the holder back plate are also no longer transferred to the workpiece being polished via the holder body. Therefore, by using a holder back plate composed of a resin having a hardness defined by the present invention, highly precise workpiece polishing can be realized with desired high degree of flatness without causing waviness.

Furthermore, since it can have a moderate hardness as a holder back plate, it shows superior adhesion with the back face of the holder body, and leak of the outer air through this adhered surface hardly occurs. Therefore, it becomes unnecessary to use an O-ring, which is conventionally used for enhancing the adhesion, and uneven distribution of stock removal of the surface during polishing the workpiece caused by unbalanced load applied on the O-ring, and bad influence on the flatness of the workpiece are substantially eliminated. Thus, highly precise polishing can be attained to such an extent that waviness is not observed on the workpiece surface even with a magic mirror.

In the aforementioned workpiece holder, the synthetic resin can be one selected from urethane resins, vinyl chloride resins and polyamide resins.

If the material of the synthetic resin is selected from those mentioned above, the range of Asker C hardness required for the present invention can be well satisfied.

The present invention also provides an apparatus for polishing a workpiece comprising a turn table adhered with a polishing pad, means for feeding a polishing agent on a surface of the polishing pad and a workpiece holder for polishing for forcibly pressing a workpiece to the surface of the polishing pad, wherein the workpiece holder for polishing is the one defined above.

By using an apparatus for polishing provided with a workpiece holder for polishing which comprises of a holder back plate made of a resin having a hardness defined by the present invention and a workpiece holder body as described above, a workpiece can be finished by polishing as a workpiece of high precision with desired high degree of flatness and no waviness on the workpiece surface even when observed by a magic mirror. In particular, when the workpiece is a semiconductor wafer, yield and productivity of highly integrated devices in a highly integrated device production step can be improved.

Further, the present invention also provides a method for polishing a workpiece, which comprises holding a back face of a workpiece by vacuum suction on the surface of the aforementioned workpiece holder for polishing used as a workpiece holding surface, and then polishing a surface of the workpiece by bringing the workpiece into contact with a polishing pad.

According to the method of the present invention, because of the use of a synthetic resin having a hardness within a specific range as the material of the holder back plate, moderate cushioning property can be imparted to the holder body. Therefore, the deformation of the holder body, which is caused by the polishing agent that penetrates through a gap between the workpiece and the holder body and solidifies in a space between the back face of the holder body and the holder back plate, is absorbed, and the transfer of this deformation to the workpiece can be prevented. In addition, the transfer of the shapes of grooves themselves for vacuum of the holder back plate to the workpiece via the holder body is also prevented. Therefore, according to the method of the present invention, there can be realized highly precise workpiece polishing with desired high degree of flatness without causing waviness on the workpiece surface even when observed by a magic mirror.

As explained above, according to the present invention, a workpiece having excellent flatness and no waviness on the workpiece surface can be stably produced, thanks to the adsorption of the synthetic resin having an Asker C hardness within the specific range as the material of the holder back plate that constitutes the workpiece holder of a polishing head portion. Although an O-ring is provided in conventional holder back plates for enhancing sealing between the back face of the holder body and the holder back plate, it becomes unnecessary in the present invention because of the superior sealing property of the holder back plate itself. This eliminates possibility that uneven distribution of stock removal of the surface is generated by unbalanced load applied on the O-ring or the flatness of the workpiece is greatly affected.

BEST MODE FOR CARRYING OUT THE INVENTION

Hereafter, embodiments of the present invention will be explained. However, the present invention is not limited to these.

As explained above, during the polishing of a workpiece, polishing agent slurry may be sucked through a small gap between the holding surface of the holder body and the workpiece held by vacuum suction, and the sucked polishing agent slurry is solidified by evaporation in a space between the back face of the holder body and the holder back plate. As a result, in the case of a conventional workpiece holder for polishing, in particular, one having a holder back plate made of metal or hard synthetic resin, stains or patterns of the polishing agent may be transferred to the workpiece being polished, and thus the quality of the polished workpiece surface may be adversely affected. In addition, there is also a problem that even the shapes of the grooves themselves of the holder back plate may be transferred to the workpiece being polished via the holder body.

Therefore, in order to solve these problems, the inventors of the present invention searched and studied about the material and the structure of the holder back plate and so forth. As a result, it was found that a highly precise workpiece with high degree of flatness and no waviness could be obtained by forming the holder back plate with a synthetic resin having a hardness within a specific range, even when pressure is applied to the holder body from its back face by stain patterns formed from adhered polishing agent slurry penetrated into the space behind the holder body and solidified therein, because the pressure is absorbed by the moderately soft resin. Then, they defined various conditions, and thus accomplished the present invention.

Figure 1:
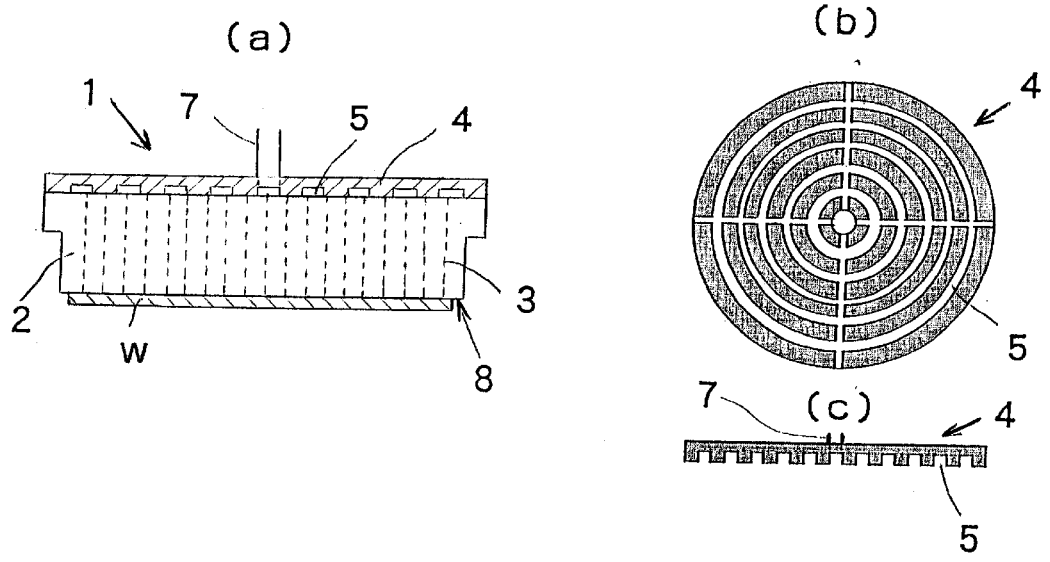
FIG. 1 represents schematic explanatory views of a workpiece holder for polishing of the present invention: (a) longitudinal sectional view, (b) front view of a holder back plate, and (c) longitudinal sectional view of the holder back plate.
Figure 2:
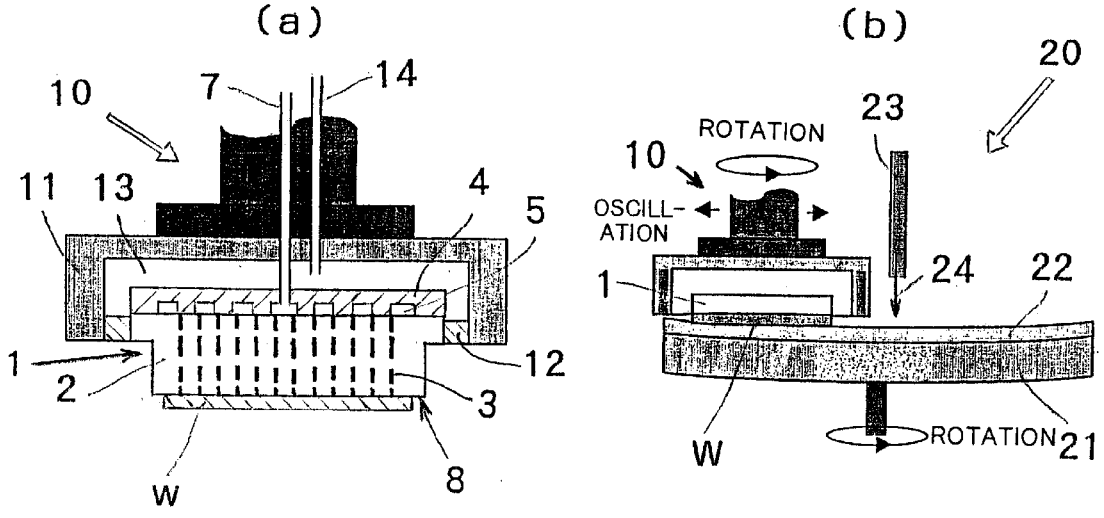
FIG. 2 represents schematic explanatory views of a polishing head provided with a workpiece holder for polishing of the present invention and a polishing apparatus having the polishing head: (a) the polishing head, and (b) the workpiece polishing apparatus.
Figure 3:
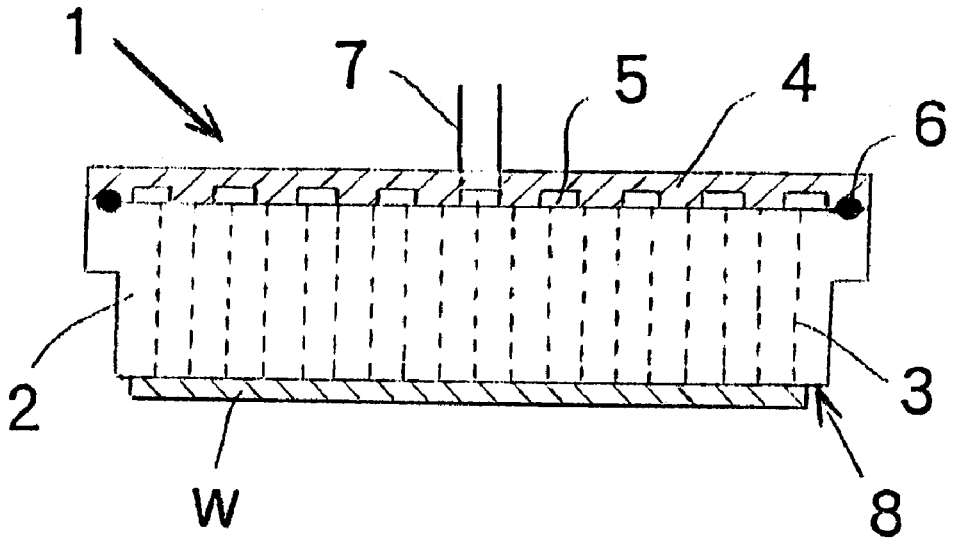
FIG. 3 represents a schematic explanatory view of a conventional workpiece holder for polishing.

First, a polishing apparatus utilizing the workpiece holder for polishing of the present invention will be explained with reference to the appended drawings. FIG. 1 is schematic explanatory views for illustrating the general structure of the workpiece holder for polishing as an example of the present invention. FIG. 2 is explanatory views for illustrating the general structures of a polishing head provided with the workpiece holder for polishing (a), and a workpiece polishing apparatus provided with the polishing head (b).

The polishing apparatus of the present invention is designed as an apparatus for polishing a single side of a workpiece, for example, a semiconductor wafer, and as shown in FIG. 2(*b*), the polishing apparatus 20 comprises of a rotating polishing turn table (turning table) 21, a workpiece holder 1 for polishing mounted on a polishing head 10, and a polishing agent feeding nozzle 23. A polishing pad 22 is adhered on the upper surface of the turn table 21. The turn table 21 is rotated at a predetermined rotation speed by a rotary shaft.

The workpiece holder 1 for polishing holds a workpiece (wafer) W on its workpiece holding surface 8 by vacuum suction or the like, and is mounted on the polishing head 10 having a rotating shaft. The holder is rotated by the polishing head 10 and simultaneously presses the workpiece W against the polishing pad 22 at a predetermined load. A polishing agent 24 is fed from the nozzle 23 at a predetermined flow rate on the polishing pad 22, and then fed between the workpiece W and the polishing pad 22, and thus the workpiece W is polished.

Further, as represented in FIG. 1(*a*) and FIG. 2(*a*), the workpiece holder 1 for polishing of the present invention is composed of a workpiece holder body 2 having a workpiece holding surface 8 and multiple perforated holes 3 for vacuum suction, and a holder back plate 4. The perforated holes 3 for vacuum suction are communicated to a vacuum apparatus not shown in the figure via grooves 5 for vacuum provided on the holder back plate 4 and a vacuum way 7, and the workpiece W can be held on the workpiece holding surface 8 upon generation of vacuum.

According to the present invention, in particular, the material of the holder back plate 4 is selected to be a synthetic resin having an Asker C hardness of 70 or higher but lower than 98.

Asker C hardness will be explained here. This hardness is measured by a method using a spring type hardness tester such as one mentioned in JIS K 6301, and represented by a distance for which an indenter point protruding from a hole provided at the center of a pressurizing surface of the tester by spring pressure is put back by a surface of a test piece, which is here a synthetic resin surface processed into a holder back plate, when the pressurizing surface of the tester is brought into contact with the test piece. Specifically, it is a value measured by using an Asker C hardness tester (according to the standard of the Society of Rubber Industry, Japan, produced by Kobunshi Keiki Co., Ltd).

By using a material of an Asker C hardness of 70 or higher but less than 98, functions as a holder back plate are sufficiently secured, and airtightness between the holder back plate and the back face of the holder body provided by the vacuum during polishing is improved. Therefore, it becomes unnecessary to provide an O-ring as conventional one. As a result, the problem that the O-ring suffers from unbalanced load is eliminated, and thus it becomes possible to obtain more stable quality. Further, even when pressure is applied to the holder body from its back face by stain patterns caused by adhesion of polishing agent produced from polishing agent slurry penetrated into the space behind the holder body and solidified, a workpiece having a highly precise surface with high degree of flatness and no waviness observed by a magic mirror can be obtained, because the pressure is absorbed by the moderately soft resin, thus the deformation of the holder body is prevented and the transfer of the deformation to the workpiece can be prevented.

The kind of the synthetic resin that constitutes the holder back plate may be one selected from urethane resins, vinyl chloride resins and polyamide resins. A material having an Asker C hardness within the aforementioned range can be readily obtained, and it can be molded into a desired shape of the holder back plate.

The arrangement of the grooves 5 for vacuum provided on the holder back plate 4 is not particularly limited. However, if they are processed into grooves in the shapes of a plurality of concentric circles and radial lines connected to the vacuum way 7 at the center of the back plate as shown in FIGS. 1(*b*) and (*c*), for example, the back plate is not deformed by vacuum pressure, even though it is made of a resin having a hardness defined by the present invention, and adhesion to the back face of the holder body can sufficiently be secured.

The polishing head 10 has, for example, a pressurized space 13 in its rotating holder 11, and holds the workpiece holder 1 for polishing airtightly via an elastomer ring 12. The pressurized space 13 communicates with an air compressor (not shown) via a pressurized way 14. The workpiece holder 1 holding the workpiece W on the workpiece holding surface 8 by vacuum suction is rotated or oscillated, and at the same time, the back face of the workpiece holder 1 is pressurized with air so as to press the workpiece holder 1 against the polishing pad 22.

The workpiece holder for polishing 1 having such a structure as described above can be fixed to a polishing head 10, which can then be mounted on a polishing apparatus 20. Polishing can be performed by holding the workpiece W on the workpiece holding surface 8 of the holder body 2 by vacuum suction, and pressing the workpiece against the rotating polishing pad 22 while adding the polishing agent 24 dropwise. By performing the polishing as described above, the transfer of stain patterns of the suctioned and solidified polishing agent to the workpiece is prevented thanks to the superior adhesion between the holder back plate made of a resin having a hardness defined by the present invention and the back face of the holder body and the property of the holder back plate for absorbing vacuum pressure, and thus the workpiece can be processed into a workpiece with high degree of flatness and no waviness.

Hereafter, the present invention will be specifically explained with reference to the following examples and comparative examples. However, the present invention is not limited to these.

EXAMPLE 1

(1) As the workpiece holder for polishing and the holder back plate, those having the structures shown in FIG. 1(*a*), (*b*) and (*c*) were used. They had diameters slightly larger than that of a wafer. The holder body had a thickness of 30 mm, and the holder back plate had a thickness of 12 mm. Grooves having a depth of 5 mm and a width of 10 mm were formed on the holder back plate.

(2) As the polishing head and the apparatus for polishing a workpiece, those having the structures shown in FIG. 2(*a*) and (*b*), respectively, were used.

(3) Workpiece: single crystal silicon wafer; diameter=200 mm; thickness=735 $\mu$m; P-type; crystal orientation=<100>; etched wafer (4) Material of holder back plate: urethane resin; Asker C hardness=70 or 90

This hardness is represented by values measured for a convex portion (portion having a larger thickness) of the aforementioned holder back plate from the side on which grooves were not formed.

(5) Workpiece polishing conditions: polishing load=250 g/cm$^2$; polishing relative velocity=50 m/min; polishing stock removal=12 $\mu$m; polishing pad=nonwoven fabric polishing pad (Asker C hardness of 80); polishing agent=colloidal silica (pH 10.5)

(6) Polishing was performed for a single side of a workpiece held by vacuum suction on the holder which was used for several times so that polishing agent slurry was adhered between the back face of the workpiece holder body and the holder back plate.

Under the above conditions, when the material of the holder back plate was a urethane resin having an Asker C hardness of 70 or 90, any particular pattern was not observed in magic mirror images after polishing of the workpieces for the both cases, and wafers with high degree of flatness and no waviness were obtained.

In this case, patterns of the solidified polishing agent that penetrated between the back face of the holder body and the convex portion of the grooves of the holder back plate should exist. It is considered that the pressure should be absorbed by the holder back plate made of a moderately soft material, and thus the transfer of the stain patterns to the surface of workpieces should be prevented.

Comparative Example 1

Polishing was performed under the same conditions as those of Example 1 except that a vinyl chloride resin of an Asker C hardness of 98 was used as the material of the holder back plate mentioned in the above (4) of Example 1.

Under this condition, unusual portions were observed in a magic mirror image after polishing of the workpiece. That is, the workpiece quality was affected. This pattern corresponded to the pattern of the solidified polishing agent penetrated into a space between the back face of the holder body and the convex portion of the grooves of the holder back plate. It is considered that change of the strength of the stress applied to the holder body is induced, and thus the pattern of the solid was transferred to the workpiece as a result.

EXAMPLE 2

The holder back plates made of urethane resins having an Asker C hardness of 70 or 90 used in Example 1 were again combined with the holder body used in the aforementioned Comparative Example 1, which had affected the workpiece quality after the workpiece polishing, to perform the polishing test under the same conditions.

As a result, a good magic mirror image was obtained after the workpiece polishing. This demonstrated that even a holder body that had stains or patterns of solidified polishing agent and had affected the workpiece quality did not affect the workpiece quality, if the material of the holder back plate combined with it was a moderately soft synthetic resin having an Asker C hardness of less than 98.

Comparative Example 2

Polishing was performed under the same conditions as those of Example 1 except that a urethane resin of an Asker C hardness of 68 was used as the material of the holder back plate mentioned in the above (4) of Example 1.

When the workpiece was released from the workpiece holding surface of the workpiece holder body, the vacuum inside the workpiece holder was broken by supplying pressurized air to the workpiece holder. In this respect, there were caused problems under the above condition, for example, a high pressure of the supplied air was required for releasing the workpiece because of swelling of the holder back plate itself due to the pressurizing, it took a long period of time to release the workpiece, and so forth. Therefore, the lower limit of the Asker C hardness of the resin used for the holder back plate was defined to be 70 or higher.

EXAMPLE 3

Polishing was performed under the same conditions as those of Example 1 except that the condition of the above (6) of Example 1 was not used, i.e., the polishing was performed for a workpiece held by vacuum suction on a holder without fixing of polishing agent slurry between the back face of the workpiece holder body and the holder back plate before the polishing.

As a result, patterns corresponding to the shape of the grooves of the holder back plate were not observed in a magic mirror image after the polishing of the workpiece. This was considered to be caused because the adhesion between the back face of the workpiece holder body and the holder back plate became extremely stronger due to the use of the softer holder back plate, and the variation of the stress applied to the holder body by the grooves in the shape of concentric circles was moderated. As a result, high degree of flatness of the workpiece was obtained, and waviness was not observed in a magic mirror. Thus, highly precise polishing was attained.

Comparative Example 3

Polishing was performed under the same conditions as those of Example 3 except that a vinyl chloride resin of an Asker C hardness of 98 was used as the material of the holder back plate.

Under this condition, patterns in the shape of concentric circles were observed in a magic mirror image after the polishing of the workpiece, and this pattern corresponded to the shapes of the grooves of the holder back plate. That is, it is considered that, because the strength of the stress applied to the holder body varied depending on the presence or absence of the grooves of the holder back plate, therefore minute unevenness was transferred to the workpiece holding surface of the holder body, and as a result, waviness was generated on the workpiece surface.

The present invention is not limited to the embodiments described above. The above-described embodiments are mere examples, and those having the substantially same structure as that described in the appended claims and providing the similar functions and advantages are included in the scope of the present invention.

For example, in the embodiments of the present invention, silicon wafers having a diameter of 200 mm (8 inches) were polished. However, the present invention can be satisfactorily used for those having a recently used larger diameter of 250 mm (10 inches) to 400 mm (16 inches) or lager, and workpieces to be polished may be precision substrates of a material other than silicon.

What is claim is:

1. A workpiece holder for polishing comprising a workpiece holder body which is provided with multiple perforated holes for holding a workpiece by vacuum suction and a holder back plate which is closely contacted with a back face of the holder body and has grooves for vacuum, wherein the holder back plate is composed of a synthetic resin and has an Asker C hardness of 70 or higher but lower than 98.

2. The workpiece holder for polishing according to claim 1, wherein the synthetic resin is one selected from urethane resins, vinyl chloride resins and polyamide resins.

3. An apparatus for polishing a workpiece comprising a turn table adhered with a polishing pad, means for feeding a polishing agent on a surface of the polishing pad and a workpiece holder for polishing for forcibly pressing a workpiece to the surface of the polishing pad, wherein the workpiece holder for polishing is one according to claim 2.

4. An apparatus for polishing a workpeice comprising a turn table adhered with a polishing pad, means for feeding a polishing agent on a surface of the polishing pad and a workpiece holder for polishing for forcibly pressing a workpiece to the surface of the polishing pad, wherein the workpiece holder for polishing is one according to claim 1.

5. A method for polishing a workpiece, comprising holding a back face of the workpiece by vacuum suction on a workpiece holding surface of a workpiece holder comprised of a workpiece holder body which is provided with holes for holding the back face of the workpiece by the vacuum suction and a holder back plate which is closely contacted with a back face of the holder body and has grooves for vacuum, wherein the holder back plate is composed of a synthetic resin and has an Asker C hardness of 70 or higher but lower than 98, and then polishing the surface of the workpiece by bringing the workpiece into contact with a polishing pad.

6. A method for polishing a workpiece, comprising holding a back face of the workpiece by vacuum suction on a workpiece holding surface of a workpiece holder comprised of a workpiece holder body which is provided with holes for holding the back face of the workpiece by the vacuum suction and a holder back plate which is closely contacted with a back face of the holder body and has grooves for vacuum, wherein the holder back plate is composed of a synthetic resin selected from urethane resins, vinyl chloride resins and polyamide resins and has an Asker C hardness of 70 or higher but lower than 98, and then polishing the surface of the workpiece by bringing the workpiece into contact with a polishing pad.

* * * * *